US005989015A

United States Patent [19]

Guerin et al.

[11] Patent Number: 5,989,015

[45] Date of Patent: Nov. 23, 1999

[54] VARIABLE FLAME RETENTION DEVICE UTILIZING AN INTERWOVEN FLEXIBLE WIRE METAL GAUZE

[75] Inventors: William Guerin, Paris; Valérie Bosso, Ermont; Bernard Verbeke, Montmagny, all of France

[73] Assignee: Gaz de France (G.D.F.) Service National, Paris, France

[21] Appl. No.: 08/961,227

[22] Filed: Oct. 30, 1997

[30] Foreign Application Priority Data

Nov. 4, 1996 [FR] France ..... 96 13402

[51] Int. Cl.[6] ..... F23D 14/14

[52] U.S. Cl. ..... 431/329; 431/328; 431/354; 239/555

[58] Field of Search ..... 431/100, 326, 431/329, 328, 349, 346, 354; 126/92 B, 92 AB; 239/552, 553.3, 553.5, 554, 555, 567, 568, 558, 559

[56] References Cited

U.S. PATENT DOCUMENTS

| | | | |
|---|---|---|---|
| 766,636 | 8/1904 | Machlet, Jr. . | |
| 3,144,073 | 8/1964 | Corey | 431/329 |
| 3,291,187 | 12/1966 | Haensel | 431/329 |
| 3,407,025 | 10/1968 | Hardison | 431/329 |
| 4,679,528 | 7/1987 | Krans et al. | 431/328 |

FOREIGN PATENT DOCUMENTS

| | | |
|---|---|---|
| 0635677 | 1/1995 | European Pat. Off. . |
| 0636837 | 2/1995 | European Pat. Off. . |
| 2231949 | 11/1990 | United Kingdom . |

*Primary Examiner*—Carl D. Price
*Attorney, Agent, or Firm*—Rothwell, Figg, Ernst & Kurz

[57] ABSTRACT

The invention relates to a gas mixing burner (80) equipped with a flame retention device (1). This device incorporates in its construction a compressed gauze of interwoven flexible metal wire or wires for said gases to flow through it, and takes the form of a ring (2), characterised in that it is constituted by a substantially coaxial stack of at least two of said rings (2). Such a device may in particular be mounted on cylindrical domestic burners.

13 Claims, 6 Drawing Sheets

VARIABLE FLAME RETENTION DEVICE UTILIZING AN INTERWOVEN FLEXIBLE WIRE METAL GAUZE

BACKGROUND OF THE INVENTION

1. Field of the Invention

The invention belongs to the field of flame retention devices for use in particular on a cylindrical gas mixing burner.

2. Description of the Background Art

Devices of this type are already known, which endeavour to stabilise the flames produced, so as to help render their development as homogeneous as possible. These devices are also known by names such as "flame retention plates" or "combustion grid".

These devices are generally produced from various materials such as ceramics or metal, and are finely perforated with holes of a suitable size and distribution to allow passage of the gases and as homogeneous a combustion process as possible. They are typicallyarranged in the burner, between the mix distribution chamber and the combustion chamber which they separate.

The drawbacks found with such devices in prior art burners include the following:

- these devices do not always stabilise the flames satisfactorily. There may be flame burnback into the mix distribution chamber, flames which stray too far from the device and heat up the walls of the combustion chamber, or else flames which cling excessively to the device and cause it to glow red-hot;
- often there is excessive production of poisonous or pollutant gases (carbon monoxide and oxides of nitrogen);
- the very structure of these devices makes it difficult to effectively regulate the power of the burners;
- there is very little, or even zero, cross-ignition of the flames; and
- it is difficult, costly and inefficient to adapt these devices to cylindrical burners.

It is therefore the object of the invention to provide a flame retention device that offers a solution to at least some of these drawbacks, at the same time as preserving low-cost manufacturing parameters.

SUMMARY OF THE INVENTION

The solution consists in a flame retention device for gas mixing burners whose construction incorporates an interwoven flexible wire(s) metal gauze for said gas to flow through, characterised by the fact that it is ring-shaped.

Although the expression "interwoven" can be used to refer equally to a knitted gauze (involving one or more wires) of the type described in European Patent Application No. EP-94 401 586.6 and to a woven gauze of the type described in Japanese patent JP-A-58 205 012, it is preferable to choose a knitted gauze because this, by reason of its meshed structure, allows substantially uniform passage of the gases over the entire surface of the device, with regular flame dispersion and good porosity, thereby enabling head losses and emissions of poisonous or pollutant gases to be reduced.

A complementary consideration concerns the ease with which said flame retention device can be manufactured. This is because it is more difficult to manufacture a thick ring (30 mm or more) than a thin ring. The device must be able to adapt itself to burners with large dimensions (e.g. for heating entire apartment blocks). The recommended solution is to place at least two rings axially one above the other, preferably having the same dimensions (internal diameter, external diameter and thickness), so as to obtain an annular device having the desired dimensions.

A second consideration is to improve the flexibility of the aeration process (air variation factor n) and the stability of the flame, to limit the production costs and overcome the problem of the flame straying off in cases where axially superposed rings are subjected to vigorous aeration. The chosen solution proposes the insertion, between two consecutive rings, of an annular stay made from a non-porous metallic material preferably able to withstand temperatures greater than 1000° C. Said stay will preferably have an internal diameter substantially identical to the internal diameter of the ring. In this manner an additional heating surface is freed up between each ring, thus allowing the number of rings to be reduced, which are more expensive to manufacture than the annular stays. Moreover, inserting stays in this way allows better flame control. This is because the effect of these annular stays is to markedly improve the distribution of the flame front and aeration flexibility (variation in air factor n) by creating what is called mutual "cross-ignition" of the flames. The addition of an annular stay between two adjacent annular rings, the external diameter of which will be less than the external diameter of the ring in order to create an annular throat, creates two control zones on either side of each ring. Over each of these two zones a gas stream exits perpendicular to the principal flame which emerges on the external circumference of the stay, at the exit from the throat. When the dimensions of the annular stays are specified in the optimum manner, and in particular as a function of the dimensions of the ring, the two gas streams meet up again and form a pilot flame parallel to the principal flame. This pilot flame develops at the exit from the throat and is held away from the edge of the stay so as to produce a homogeneous flame front with cross-ignition of the flames. The respective dimensions of the rings and the annular stays are specified so as to optimise the stabilisation of the principal flame by the pilot flame whilst preserving good cross-ignition.

A third consideration concerns the efficiency of the flame retention device (flame stability and homogeneity; cross-ignition), which depend to a large extent on the respective dimensions of the rings and the stays. The thickness of the annular stay will preferably be less than the thickness of the ring, and the difference between the external radius and the internal radius of the annular ring will be substantially the same as the thickness thereof (substantially square or rectangular in cross-section), and the difference between the external diameter of the ring and the external diameter of the annular stay will be substantially the same as the thickness of the annular stay. In this manner the optimum in flame control, optimum flame front stability and maximum flexibility aeration are achieved, at the same time as low poisonous or pollutant gas discharges.

A fourth considertion is directed to resolving the problem of how to control the first (upstream) and last (downstream) ring of the stack. The solution lies in partly obturating, preferably in a ratio of 4/5, the peripheral surface of these two rings where the principal flame develops so as to only free up a control zone (representing the remaining fifth of the area).

A fifth consideration is directed to resolving the problem of how to obturate the flame retention device at its downstream extremity. The solution lies in arranging, on the downstream ring of the flame retention device, a non-porous circular obturation plate made of a material capable of withstanding high temperatures (greater than 1000° C). The obturation plate will preferably have an external diameter substantially the same as the external diameter of one ring and a thickness such that it does not become warped under the action of the heat. In relation to this fifth consideration, the invention proposes to resolve the problem of how to fix the flame retention device detachably onto the burner.

These means for detachable fixing will preferably be in the form of a threaded rod passing axially through the flame retention device and connected to the burner by tabs and to the obturation plate by a nut. These means may alternatively be constituted by a plurality of threaded rods arranged on an imaginary circle whose diameter will be close to the internal diameter of the device and which will directly connect the burner to the obturation plate (without any tabs). Alternatively again, however, these means may be arranged on the outside of the device and take the form of flanges.

A sixth consideration concerns how to centre the ring or rings of the annular stay or stays so as to obtain a stack with perfect axial alignment. The solution is to equip the annular stay with centring lugs, preferably at least eight of them, disposed in a staggered arrangement on either side of the thickness of the stay. These lugs are rigidly joined, notably welded, to the internal walls of the stay and are distributed around the internal circumference thereof, preferably at 90° to one another.

The invention also relates to a cylindrical burner of the general gas mixing type, comprising a chamber for distributing the mix supplied with oxygen-carrying air and fuel gas, communicating with a combustion chamber, with the device according to the invention interposed between them.

It will be possible to employ the device according to the invention in particular for domestic burners (rated at several tens of kilowatts), for example using an air/gas complete combustion premix, notably enabling high-level power regulation to take place, which may range between, for example, 5 and 25 kilowatts, i.e. power regulation of 1:5. The device according to the invention can also be fitted to central boilers servicing apartment blocks (rated at several hundred kilowatts) by adapting the size of the burner to the power required.

In these various scenarios, the external diameter of the rings will be chosen as a function of the size of the combustion chamber.

BRIEF DESCRIPTION OF THE DRAWINGS

Still further features and advantages of the invention will become apparent from the description which follows, with reference to the accompanying drawings which are provided solely by way of example, and in which.

DETAILED DESCRIPTION OF THE PREFERRED EMBODIMENTS

Figure 1:
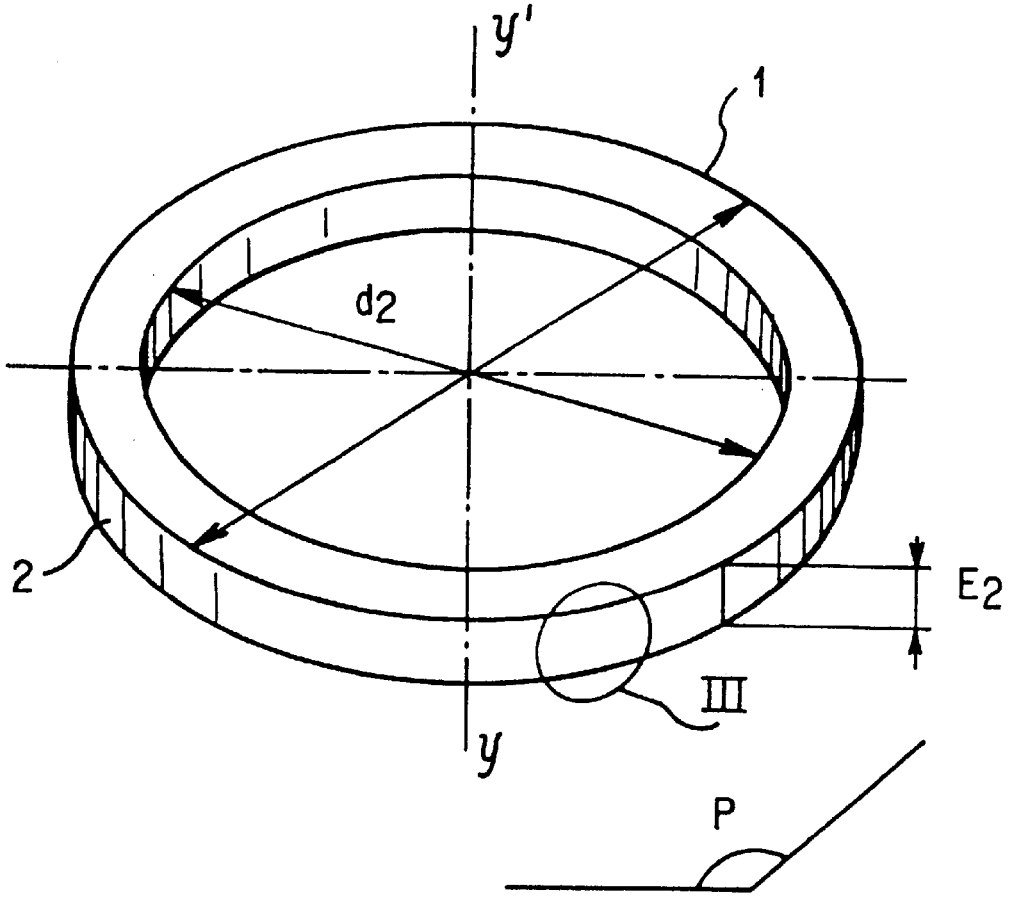
FIG. 1 is a perspective view showing a flame retention device in accordance with the invention.

Referring now to FIG. 1, a flame retention device for a gas mixing burner is shown, in accordance with the invention, and identified generally by reference numeral 1. Preferably substantially planar, this device is in the form of a ring 2, here a perfect circle, of external diameter D2, internal diameter d2 and thickness E2, and has a principal axis or normal axis symbolised by the letters yy'. This type of ring is manufactured and sold by the firm of Tissmetal (of Reims, France). It will be readily understood that the ring may be of any shape (square, triangle, star, ellipsis, etc.) in a plane P perpendicular to its normal axis yy', with the preferred shape being circular (both along its external and internal perimeters).

Figure 2:
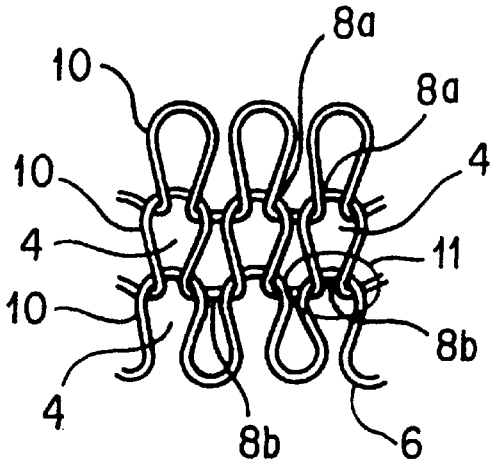
FIG. 2 shows a constructional detail of the knitted gauze seen in FIG. 1, at reference point III in said FIG. 1.

In FIG. 2 it can be seen that the device 1 incorporates in its construction a gauze of flexible metal wire or wires, with interlaced parts, incorporating passages 4 (or openings) formed by the meshes of the "knit" and through which the gases will flow. It is perfectly possible to configure the gauze with interwoven parts by knitting one (of the) wire(s) or by weaving a plurality of wires, with the weft wires perpendicular to the others (warp wires). This gauze of wire(s), or tracery, is represented here as a knitted article constituted by at least one wire. Specifically, this knitted article is manufactured with a single wire 6 constituted by a flexible metallic material which can readily be knitted, such as for example "304L" stainless steel 1 to 3 millimetres in diameter. At all events, the material used to make the device will preferably have to retain its characteristics (especially its mechanical characteristics) up to high temperatures of approximately 1000° C. to 1200° C.

As seen in FIG. 2, the wire 6 may be said to have been "knitted" in the way that a sock is knitted, but other methods of conventional interlocking or braiding would also be possible (for example weaving). This Figure schematically illustrates the way in which the "Ω" (Omega) shaped loops 8*a* and 8*b* of the wire 6 are able to interlace with one another. Sections 10 of the wire 6 which overlap one another from underneath accordingly present zones of interweaving as identified at 11, and these sections 10 form "upper" loops 8*a* which pass through the loops 8*b* which are lower than them, thereby delimiting the passages 4. For the sake of clarity these passages in the knitted article have been depicted in a relatively relaxed state, but these same passages are distributed throughout the gauze structure in a compressed state according to a form, size and arrangement which vary as a function of the compression forces exerted.

Figure 3:
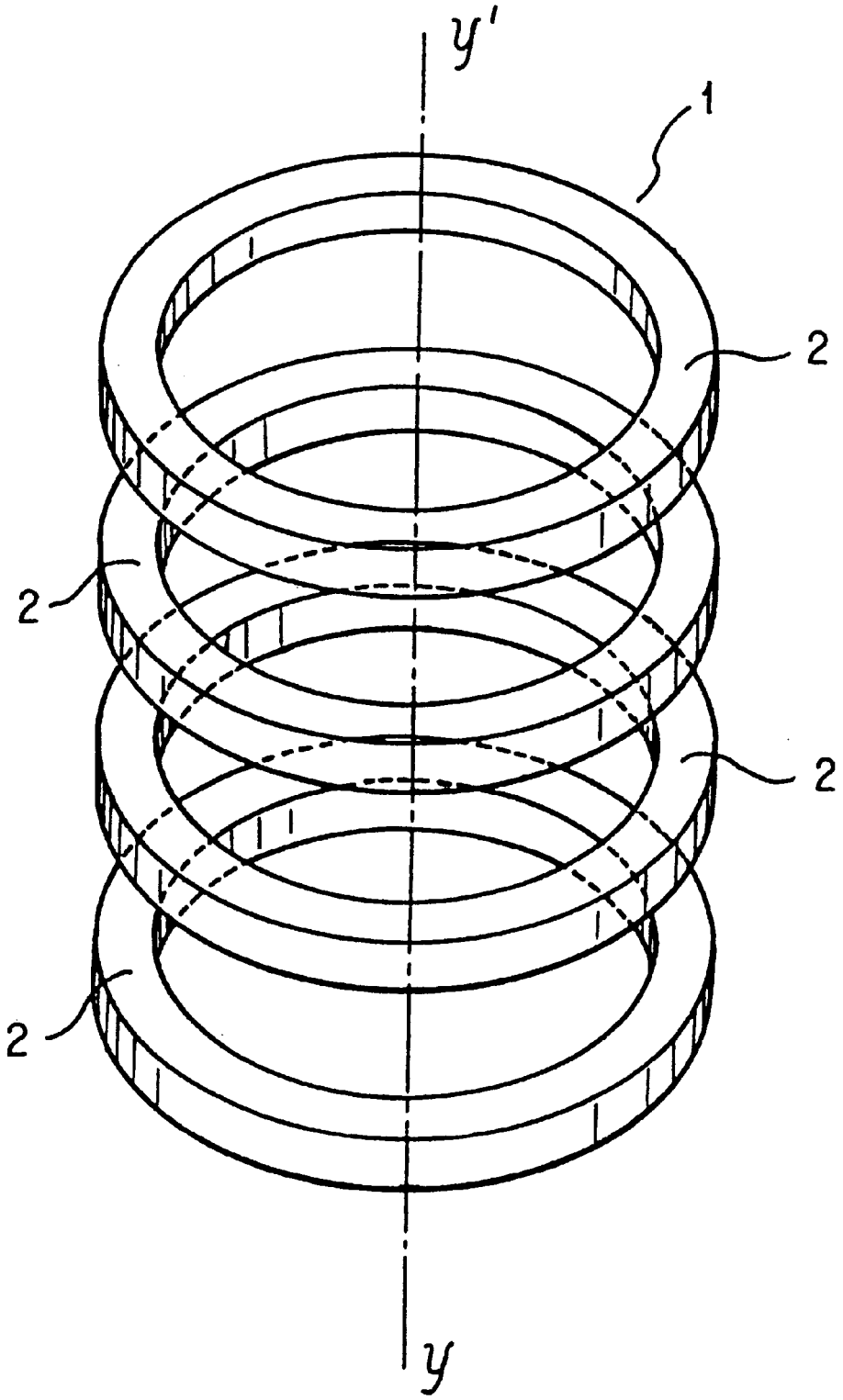
FIG. 3 is an exploded projection of a flame retention device made up of a plurality of circular rings.

FIG. 3 shows a variant of the invention in which the device is made up of a plurality of identical circular rings 2, positioned one above the other along a principal axis of symmetry yy' (also known as the axis of the stack). This configuration makes it possible to obtain a thicker device 1, which would be difficult to achieve with a single part.

Figure 4:
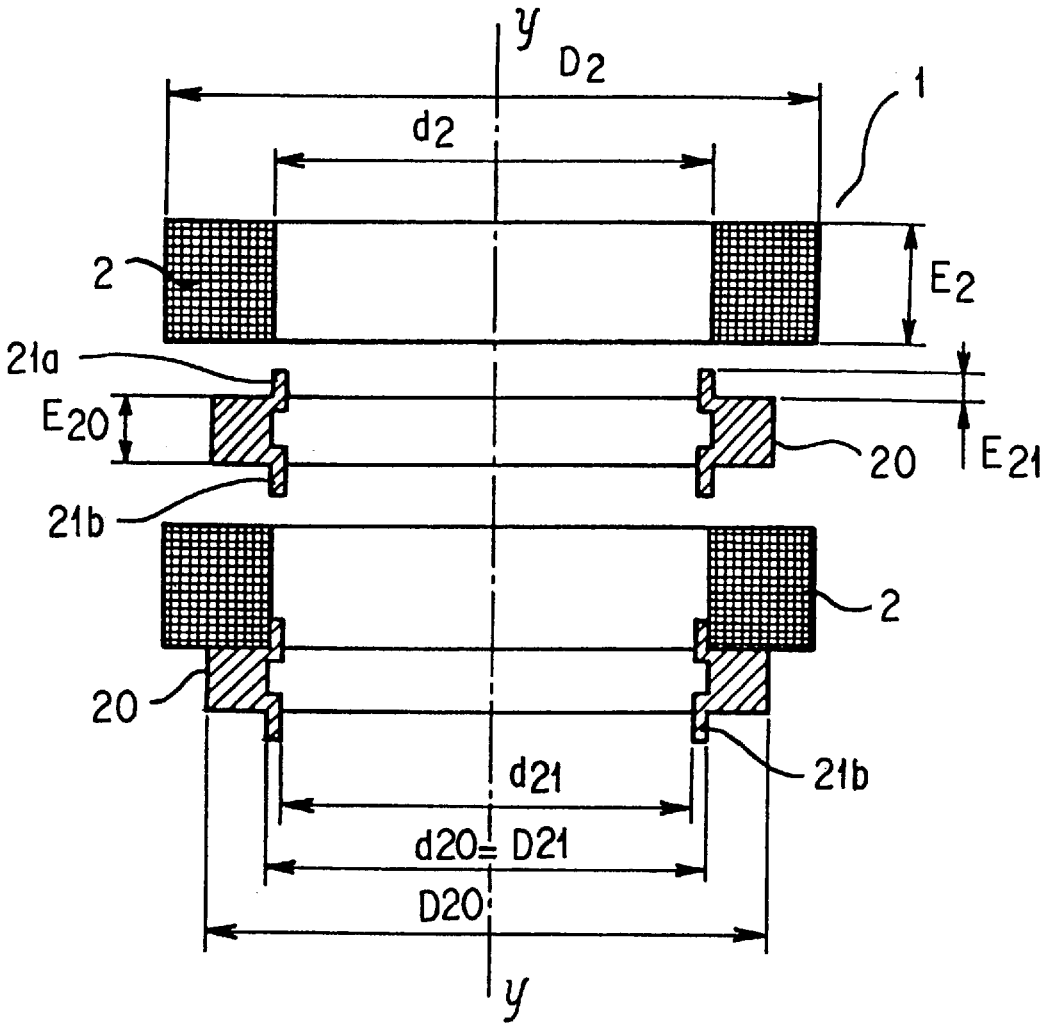
FIG. 4 is a sectional view showing the flame retention device seen in FIG. 6 fitted with annular stays inserted between two consecutive rings.

FIG. 4 shows an alternative form of embodiment of the flame retention device 1 in which an annular stay 20 made from a non-porous metallic material is inserted betwen two consecutive rings 2. This stay 20 possesses an internal diameter d20 substantially the same as the internal diameter d2 of the ring 2 and an external diameter D20 less than the external diameter D2 of said ring 2. The dimensions of this annular stay 20 are critical. The stay 20 is preferably fitted with a plurality of means 21 for centring the rings 2, in the form of lugs (21*a*, 21*b*, . . . ) welded on either side of the thickness E20 of the stay along its internal diameter d20.

Figure 5:
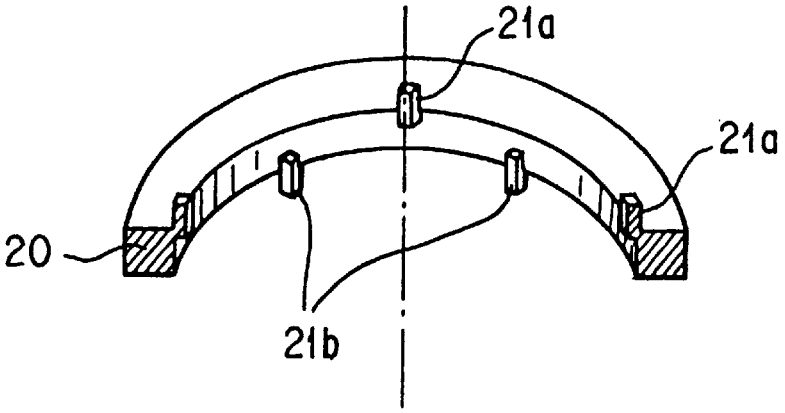
FIG. 5 is a plan view from FIG. 4 depicting a stay fitted with its centring means.

FIG. 5 is a plan view showing a stay 20 fitted with eight centring lugs (21*a*, 21*b*, . . . ) distributed in two groups of four lugs arranged on either side of the thickness E20 of said stay, preferably at 90° to one another, the two groups being staggered (offset by 45°) with respect to one another as shown. Each group of four centring means defines a virtual ring of external diameter D21 substantially the same as the internal diameter d20 of the stay 20 and the internal diameter d2 of the ring 2 in order to promote the centring of the latter on the stay 20. The thickness E21 of these lugs will not be very great, of the order of a few millimetres, so as to promote good centring without impeding the flow of the gases through the passages 4 of the device 1. For the same reasons, the internal diameter d21 of the two virtual rings defined by the lugs 21*a* and 21*b* will be slightly less than the external diameter D21 in order to avoid excessive disturbance to the gas stream.

Figure 6:
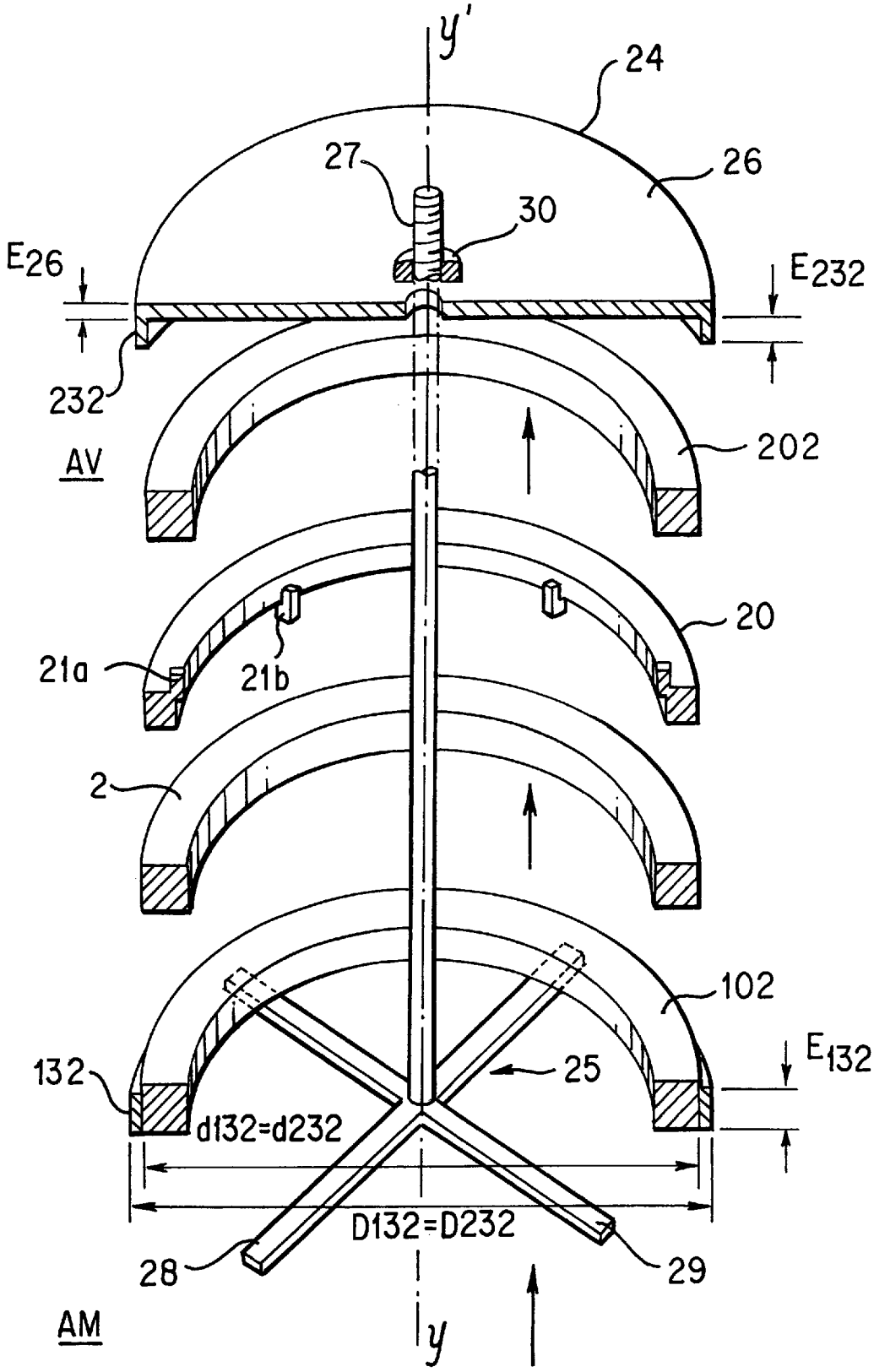
FIG. 6 is an exploded perspective half-view of the fastening means for obturating and covering the ring or rings of the device.

FIG. 6 shows the cover means 132 and 232 for an upstream ring 102 and for a downstream ring 202, the latter being the final ring in the stack or the ring arranged furthest downstream in relation to the direction of gas flow, symbolised by the letters US (upstream) and DS (downstream). In the case where there is only a single ring 2, these cover means 132 and 232 will not be necessary. These cover means 132 and 232 are constituted by a first hoop 132 disposed around the upstream ring 102, and by a second hoop 232 disposed around the downstream ring 202. Each hoop 132 and 232 will preferably have a thickness E132 and E232 such that it will cover approximately four-fifths (4/5) of the thickness of each of the upstream rings 102 and downstream rings 202, so as to allow good flame control. These hoops 132 and 232 will have an internal diameter d132 and d232 slightly greater than the external diameter D2 of the rings 102 and 202, and an external diameter D132 and D232 slightly greater than their internal diameter d132 and d232. Moreover, they will be produced from a non-porous material preferably able to withstand temperatures above 1000° C.

FIG. 6 also shows the obturation means 24 and fixing means 25 of the flame retention device 1, in an embodiment in which the device 1 is constituted by a plurality of rings 2 and a plurality of stays 20 inserted between two consecutive rings 2 (for the sake of clarity only one stay 20 is depicted between a ring 2 and the downstream ring 202). These obturation means 24 are constituted by a solid circular end plate 26, preferably able to withstand temperatures above 1000° C. This end plate 26 is disposed on the downstream ring 202 and is fixed, for instance welded, to the cover means 232 of the downstream ring 202. In this manner the gases are forced to pass through the flame retention device 1, and hence to pass through the passages defined by the compressed latticework of knitted wire or wires. The external diameter D26 of the end plate 26 will preferably be substantially the same as the external diameter D2 of the downstream ring 202, and its thickness E26 will be sufficient to prevent the end plate 26 from becoming warped under the effect of the heat.

The fixing means 25 are represented by a threaded rod 27 which passes axially through the centre of the flame retention device 1 and the end plate 26, tabs 28 and 29 locating on the burner and a nut 30 tightening the end plate 26 onto the burner 80. Accordingly, the ring or rings 2 (with or without stays) are compressed slightly between the end plate 26 and the burner 80, and are fixed thereto in a removable manner. The flame retention device 1 can therefore easily be replaced, or even just one ring 2 or just one stay 20.

Figure 7:
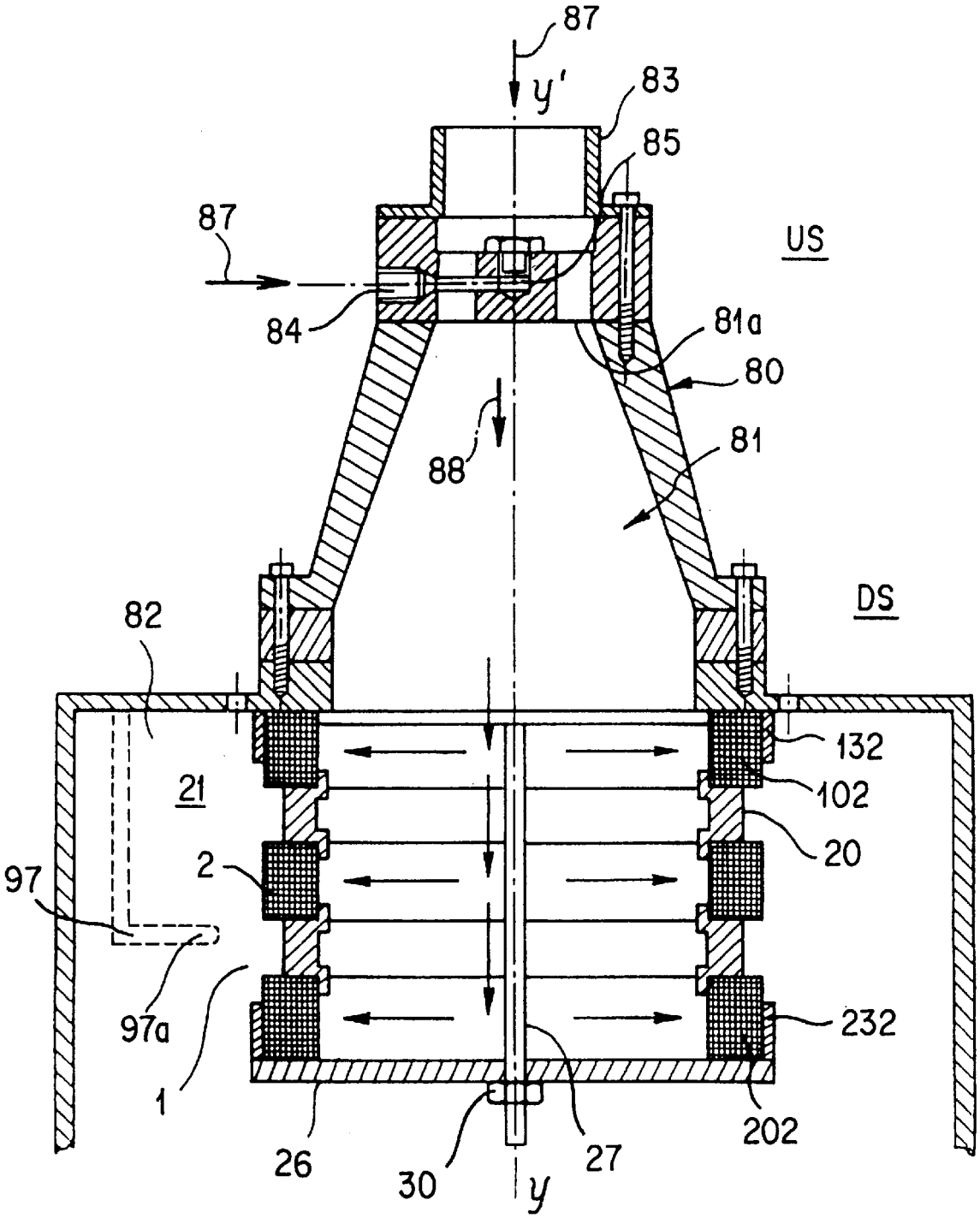
FIG. 7 is a median vertical section showing one possible application for the device of the invention, on a gas burner.

Turning now to FIG. 7, this shows a device 1, mounted in a conventional type of burner, and identified generally as 80, such as for example a complete-combustion premixing domestic burner.

This burner 80 essentially comprises a distribution chamber 81 which has the general form of a chamber shaped like a truncated cone, of substantially circular cross-section, connected at the level of its narrowest rear face 81*a* to separate pipes 83, 84 for respectively supplying oxygen-carrying air and fuel gas. In this Figure, the letters US and DS respectively identify the "upstream" and "downstream" sides of the burner, with reference to the flow of the fuel mix inside the burner, as schematised by arrows 87, 87' and 88. This distribution chamber 81 is separated from a combustion chamber 82, on its front face, by the flame retention device 1. In this particular case, this device is in the form of a plurality of rings 2 positioned one above the other and fixed to the burner 80 by fixing means 25 such as a threaded rod 27, tabs 28 and 29 and a nut 30. The flame retention device 1 is obturated, on a downstream ring 202, by a non-porous rigid plate 26 through which the threaded rod 27 can be introduced. In the form of embodiment in which the flame retention device is made up of a single ring, the downstream ring 202 is formed by this single ring 2 and the end plate 26 is disposed on said ring 2. As can be seen in FIG. 7, the fuel gas supply pipe 84 meets the air supply pipe 83 just upstream of the distribution chamber (at 85). Although in this case it has been decided to install a vent upstream of the pipe 83 (supplying pressurised air), it is possible to make provision for the premixing of the gases (gas+air) to take place before the distribution chamber 81.

As illustrated, the burner is ignited by an electrode 97 which is suitably insulated and supplied at high voltage by a feeder cable (not shown); the ignition is by means of sparks or electric arc between the point 97*a* of the electrode and, for example, the neighbouring wall of a stay or of a ring.

By way of example only, the flame retention device will be constituted by a metal steel wire latticework made of "304L" stainless steel and may be constituted by a stack of rings of external diameter D=90 mm, of internal diameter d=60 mm and of thickness E=15 mm.

Likewise by way of example only, the air factor (n)obtained in a gas burner rated at 25 kW and fitted with the device according to the invention will vary from 1.15 to 1.45 without the annular stay, and from 1.16 to 1.62 with the annular stay, whereas it varies from 1 to 1.29 for a standard burner rated at 31 kW.

Figure 8:
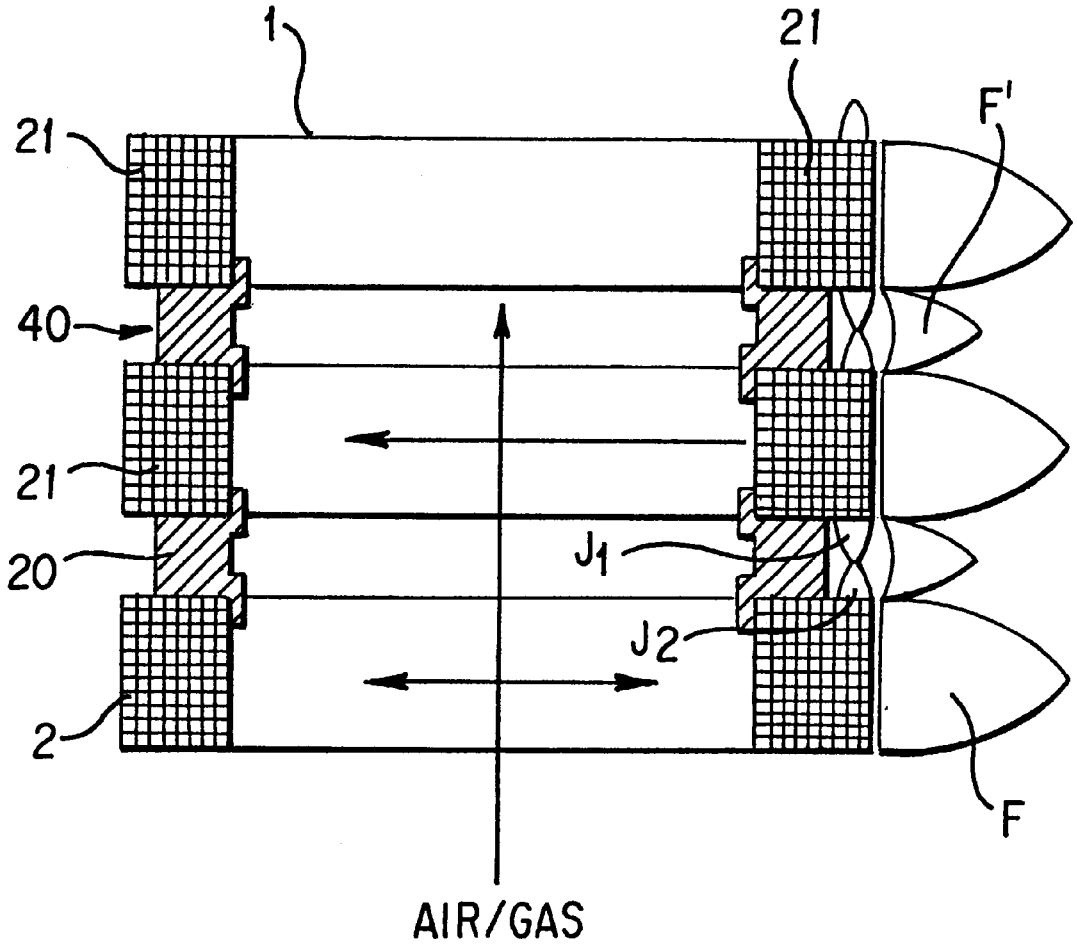
FIG. 8 shows a detail from FIG. 7 depicting a flame front obtained with the stays.

FIG. 8 is a detail showing the flame front obtained by the assembly constituted by the flame retention device and the associated burner from FIG. 7. A throat 40 running all round the device is defined between two adjacent rings 2, and facing the stay 20. Emerging on the upper and lower edges of the rings are air+gas mixer jets J1 and J2 which run all round the device. These jets are parallel to the axis yy' and are directed towards one another. If the dimensions of the stay have been chosen correctly, these two gas jets will meet in the throat 40 and create a pilot flame F' perpendicular to the axis yy' and held away from the edge of the stay. This pilot flame F' ensures the stabilisation and homogeneity of the flame front F, preventing the latter from breaking up in the ring/stay contact zones. As much pilot flame F' will develop as there is stay. There will preferably be no stay between the burner and the upstream ring 102, nor beyond the downstream ring 202. Thanks to the additional space which the stays 20 free up between the rings 2, the number of rings can accordingly be reduced, which in turn helps to reduce the cost of the burner.

We claim:

1. A device for flame retention for use on a gas mixing burner, wherein said device comprises a stack of at least two substantially coaxial rings, each ring comprising a compressed gauze made of at least one knitted metal wire through which said gas can flow.

2. The device according to claim 1, wherein a non-porous annular stay, having an internal diameter, an external diameter, and a thickness is interposed successively between two adjacent rings, each ring having an internal diameter, an external diameter and a thickness.

3. The device according to claim 2, wherein the internal diameter of each stay is substantially the same as the internal diameter of the rings.

4. The device according to claim 1, wherein an external diameter of each stay is less than an external diameter of the rings.

5. The device according to claim 1, wherein a thickness of each stay is less than a thickness of the rings.

6. The device according to claim 1, wherein a difference between an external diameter and an internal diameter of each stay is substantially double a thickness of a stay.

7. The device according to claim 1, wherein a difference between an external diameter of the rings and an external diameter of each stay is substantially the same as a thickness of said stay.

8. The device according to claim 1, wherein each annular stay has an internal diameter and is fitted, on said internal diameter, with a centering means which helps to align the stacked rings.

9. The device according to claim 1, wherein an upstream ring and a downstream ring, each having an external peripheral surface, are fitted with circular cover means which obturate four-fifths of the external peripheral surface of said rings.

10. The device according to claim 1, wherein a downstream ring, having an external diameter, is fitted with obturating means, such as a solid, circular, heat-resistant end plate, said plate having an external diameter which is substantially the same as the external diameter of said downstream ring.

11. The device according to claim 10, wherein the end plate and the cover means of the downstream ring are fixed together.

12. The device according to claim 1, wherein said device is fitted with removable fixing means which connect the device internally or externally to the burner or to the end plate.

13. Gas burner having a gas distribution chamber supplied with oxygen-carrying air and fuel gas and communicating with a combustion chamber, there being interposed between these chambers a flame retention device according to claim 1.

* * * * *